US009267502B2

(12) United States Patent
Enami et al.

(10) Patent No.: US 9,267,502 B2
(45) Date of Patent: Feb. 23, 2016

(54) MOTOR-DRIVEN COMPRESSOR

(71) Applicants: KABUSHIKI KAISHA TOYOTA JIDOSHOKKI, Kariya-shi, Aichi-ken (JP); GIFU HIGHTECH CO., LTD., Anpachi-gun, Gifu-ken (JP)

(72) Inventors: Shingo Enami, Kariya (JP); Tsuyoshi Yamaguchi, Kariya (JP); Yoshikazu Fukutani, Kariya (JP); Akio Fujii, Kariya (JP); Takeshi Hamanaka, Gifu (JP)

(73) Assignees: KABUSHIKI KAISHA TOYOTA JIDOSHOKKI, Aichi-ken (JP); GIFU HIGHTECH CO., LTD., Gifu-ken (JP)

( * ) Notice: Subject to any disclaimer, the term of this patent is extended or adjusted under 35 U.S.C. 154(b) by 322 days.

(21) Appl. No.: 13/909,791

(22) Filed: Jun. 4, 2013

(65) Prior Publication Data

US 2013/0330217 A1 Dec. 12, 2013

(30) Foreign Application Priority Data

Jun. 8, 2012 (JP) ..... 2012-131164

(51) Int. Cl.
*F04B 39/14* (2006.01)
*F04C 23/02* (2006.01)
(Continued)

(52) U.S. Cl.
CPC ..... *F04C 23/02* (2013.01); *F04B 35/04* (2013.01); *F04B 39/121* (2013.01); *F04B 39/14* (2013.01);
(Continued)

(58) Field of Classification Search
CPC ..... F04B 35/04; F04B 39/12; F04B 17/03; F04B 39/121; F04C 23/02; F04C 23/008; F04C 18/0215; F04C 2240/30; F04C 2240/803; F04C 2240/808; H01R 12/716; H01R 13/5213
USPC ..... 417/410.1, 902
See application file for complete search history.

(56) References Cited

U.S. PATENT DOCUMENTS 4,131,331 A 12/1978 Kendall, Jr.
4,964,788 A 10/1990 Itameri-Kinter et al.
(Continued)

FOREIGN PATENT DOCUMENTS

CN 102213208 A 10/2011
EP 0447607 A2 8/1990
(Continued)

OTHER PUBLICATIONS

Extended European Search Report dated Sep. 26, 2013, issued in corresponding European Patent Application.
(Continued)

*Primary Examiner* — Charles Freay
*Assistant Examiner* — Philip Stimpert
(74) *Attorney, Agent, or Firm* — Sughrue Mion, PLLC

(57) ABSTRACT

A motor-driven compressor includes a compression unit, an electric motor, a housing that includes an accommodating chamber and a wiring connection port, a motor driving circuit that includes a substrate arranged in the accommodating chamber, wiring electrically connected to the substrate and extending out of the housing through the wiring connection port, and a resin sealing member fitted to the wiring connection port. The wiring includes a primary conductor, which has a first end connected to the substrate and a second end, and a secondary conductor, which is connected to the second end of the primary conductor and arranged outside the housing. The secondary conductor includes a wire portion and a sheath that is made of an insulating material and covers the wire portion. The sealing member covers the sheath and a junction between the primary conductor and the secondary conductor.

9 Claims, 4 Drawing Sheets

(51) Int. Cl.

| | |
|---|---|
| ***F04B 35/04*** | (2006.01) |
| ***F04C 23/00*** | (2006.01) |
| ***F04B 39/12*** | (2006.01) |
| ***H01R 12/71*** | (2011.01) |
| *H01R 13/52* | (2006.01) |
| *F04C 18/02* | (2006.01) |

(52) U.S. Cl.

CPC ..... *F04C 23/008* (2013.01); *H01R 12/716* (2013.01); *F04C 18/0215* (2013.01); *F04C 2240/30* (2013.01); *F04C 2240/803* (2013.01); *F04C 2240/808* (2013.01); *H01R 13/5213* (2013.01)

(56) References Cited

U.S. PATENT DOCUMENTS

| | | | | |
|---|---|---|---|---|
| 5,000,695 | A | 3/1991 | Nishiyama et al. | |
| 5,780,774 | A | 7/1998 | Ichikawa et al. | |
| 5,795,170 | A | 8/1998 | Okabe | |
| 7,056,104 | B2 * | 6/2006 | Kimura et al. | 417/410.1 |
| 2002/0025265 | A1 | 2/2002 | Ikeda | |
| 2006/0068626 | A1 * | 3/2006 | Hasegawa | 439/276 |
| 2007/0178723 | A1 | 8/2007 | Kataoka et al. | |
| 2009/0053082 | A1 * | 2/2009 | Kitano | 417/422 |
| 2011/0175470 | A1 | 7/2011 | Kinoshita et al. | |
| 2011/0268593 | A1 | 11/2011 | Yamada et al. | |

FOREIGN PATENT DOCUMENTS

| | | | |
|---|---|---|---|
| JP | 08-111260 | A | 4/1996 |
| JP | 08-220117 | A | 8/1996 |
| JP | 08330003 | A | 12/1996 |
| JP | 2003328944 | A | 11/2003 |
| JP | 2004259536 | A | 9/2004 |
| JP | 2005-071668 | A | 3/2005 |
| JP | 2006-332005 | A | 12/2006 |
| JP | 2007-209100 | A | 8/2007 |
| JP | 2008010322 | A | 1/2008 |
| JP | 2009278852 | A | 11/2009 |
| JP | 2010-041871 | A | 2/2010 |
| JP | 2011-144788 | A | 7/2011 |

OTHER PUBLICATIONS

Communication dated Jun. 3, 2015 from the State Intellectual Property Office of the People's Republic of China in counterpart application No. 201310221536.1.

* cited by examiner

MOTOR-DRIVEN COMPRESSOR

BACKGROUND OF THE INVENTION

The present invention relates to a motor-driven compressor that includes a compression unit and an electric motor, which are accommodated in a housing, and a substrate of a motor driving circuit, which is accommodated in an accommodating chamber defined in the housing.

Japanese Laid-Open Patent Publication No. 2011-144788 describes an example of a motor-driven compressor that is installed in a vehicle. As shown in FIG. 7, a motor-driven compressor 80 includes a housing 81 accommodating a compression unit and an electric motor 82. The housing 81 includes one axial end connected to an inverter housing 84.

The housing 81 and the inverter housing 84 define an accommodating chamber that accommodates a motor driving circuit 85. The inverter housing 84 includes a tubular connector coupler 86. The inverter housing 84 also includes an insertion opening 87 that communicates the connector coupler 86 and the accommodating chamber 83.

An inner connector 89, which includes a bus bar 88, is inserted in the insertion opening 87. The inner connector 89 also includes an insulator 90, which covers the U-shaped bus bar 88, and has a plate form. The bus bar 88 includes a first end 88*a*, which is inserted in the connector coupler 86, and a second end 88*b*, which is inserted in the accommodating chamber 83. The second end 88*b* of the bus bar 88 is connected to a substrate 85*a* of the motor driving circuit 85. A grommet 91 is arranged in the insertion opening 87 surrounding the inner connector 89. The insertion opening 87 is closed by a lid 92 attached to the inverter housing 84. The connector coupler 86 is connected with a connector 94, which extends from the vehicle. The connector 94 is connected to the first end 88*a* of the bus bar 88.

However, in the motor-driven compressor 80, the connector coupler 86 projects from the outer surface of the inverter housing 84. The projecting connector coupler 86 enlarges the motor-driven compressor 80. In addition, the connector coupler 86 is formed integrally with the inverter housing 84, and the connector coupler 86 is fixed. Thus, the connector coupler 86 may hinder installation of the motor-driven compressor 80 in a vehicle. Further, connection of the connector 94 to the connector coupler 86 may be difficult.

It is an object of the present invention to provide a motor-driven compressor that is free from a connector coupler formed integrally with a housing to avoid disadvantages resulting from such a connector coupler.

To achieve the above object, one aspect of the present invention is a motor-driven compressor including a compression unit that performs a compression operation, an electric motor that drives the compression unit, a housing that accommodates the compression unit and the electric motor and includes an accommodating chamber and a wiring connection port, which communicates the accommodating chamber and the exterior of the housing, a motor driving circuit that controls driving of the electric motor and includes a substrate, which is arranged in the accommodating chamber, wiring electrically connected to the substrate and extending out of the housing through the wiring connection port, and a resin sealing member fitted to the wiring connection port. The wiring includes a primary conductor, which has a first end connected to the substrate and a second end, and a secondary conductor, which is connected to the second end of the primary conductor and arranged outside the housing. The secondary conductor includes a wire portion and a sheath that is made of an insulating material and covers the wire portion.

The sealing member covers the sheath and a junction between the primary conductor and the secondary conductor.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Referring to FIGS. 1 to 6, a motor-driven compressor according to one embodiment will now be described. The motor-driven compressor is installed in a vehicle and used with a vehicle air-conditioning device.

Figure 1:
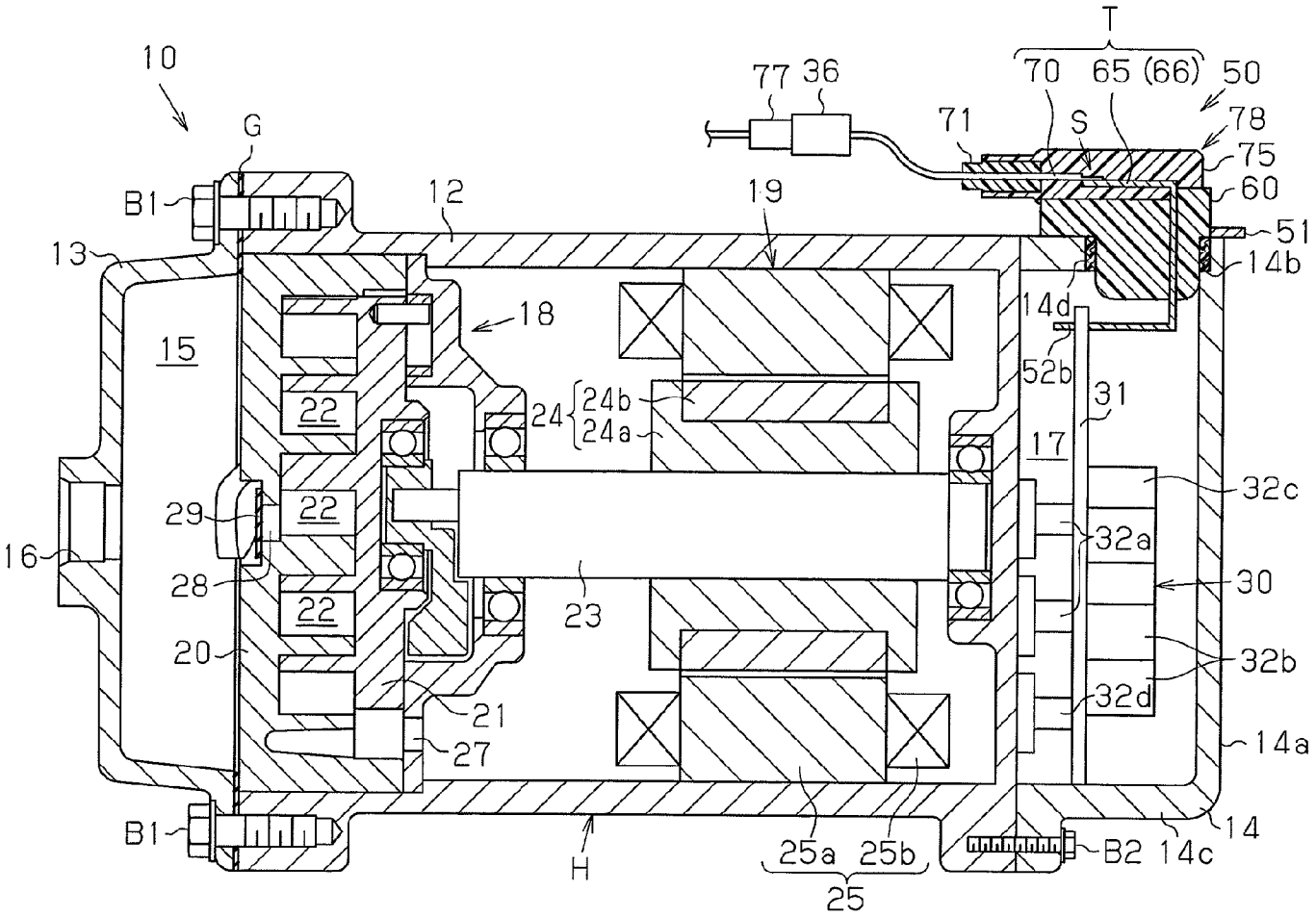
FIG. 1 is a cross-sectional view showing a motor-driven compressor according to one embodiment.

As shown in FIG. 1, a motor-driven compressor 10 includes a housing H, which includes a middle housing member 12, a discharge housing member 13, and an inverter housing member 14. The middle housing member 12, which is located in the middle of the housing H, is cylindrical and has one closed end. The discharge housing member 13, which is connected to the open end of the middle housing member 12, is cylindrical and has one closed end. The inverter housing member 14, which is connected to the closed end of the middle housing member 12, is cylindrical and has one closed end. Bolts B1 fasten the middle housing member 12 and the discharge housing member 13 to each other. A gasket G is arranged between the middle housing member 12 and the discharge housing member 13. Bolts B2 fasten the middle housing member 12 and the inverter housing member 14 to each other. The middle housing member 12 and the inverter housing member 14 form an accommodating chamber 17.

The middle housing member 12 and the discharge housing member 13 form a discharge chamber 15. The closed end of the discharge housing member 13 includes a discharge port 16. The discharge port 16 connects the discharge chamber 15 to an external refrigerant circuit (not shown). The middle housing member 12 includes a suction port (not shown) near the inverter housing member 14. The suction port connects the middle housing member 12 to the external refrigerant circuit.

The middle housing member 12 accommodates a rotation shaft 23 that is rotatably supported. The middle housing member 12 also includes a compression unit 18, which compresses a refrigerant, and an electric motor 19, which drives the compression unit 18. The accommodating chamber 17 accommodates a motor driving circuit 30 that controls driving of the electric motor 19. The compression unit 18, the electric motor 19, and the motor driving circuit 30 are arranged in this order in the housing H along the axial direction of the rotation shaft 23.

The compression unit 18 includes a fixed scroll 20, which is fixed in the middle housing member 12, and a movable scroll 21, which is engaged with the fixed scroll 20. The fixed scroll 20 and the movable scroll 21 form a compression chamber 22 that has a variable volume. The fixed scroll 20 includes a discharge passage 28 that communicates the compression chamber 22 and the discharge chamber 15. A discharge valve 29 is arranged in an end surface of the fixed scroll 20.

The electric motor 19 includes a rotor 24, which rotates integrally with the rotation shaft 23, and a stator 25, which is fixed to the inner surface of the middle housing member 12 and surrounds the rotor 24. The rotor 24 includes a rotor core 24*a*, which is fixed to the rotation shaft 23 and rotated integrally with the rotation shaft 23, and a plurality of permanent magnets 24*b*, which are arranged on the periphery of the rotor core 24*a*. The stator 25 includes a stator core 25*a*, which is annular and fixed to the inner surface of the middle housing member 12, and coils 25*b*, which are wound around the teeth (not shown) of the stator core 25*a*.

The motor driving circuit 30 is arranged in the accommodating chamber 17 and includes a plate-like substrate 31, which is fixed to the inner surface of the inverter housing member 14, and various types of electric components 32*a*-32*d*, which are mounted on the substrate 31. The substrate 31 extends in the radial direction of the rotation shaft 23 in the inverter housing member 14. The motor driving circuit 30 supplies power to the stator 25 of the electric motor 19 based on instructions from an air-conditioning ECU (not shown).

In the motor-driven compressor 10, the rotor 24 rotates when power is supplied to the electric motor 19 from the motor driving circuit 30. The rotation of the rotor 24 rotates the rotation shaft 23. The rotation of the rotation shaft 23 decreases the volume of the compression chamber 22 formed by the movable scroll 21 and the fixed scroll 20 in the compression unit 18. A refrigerant is drawn into the middle housing member 12 from the external refrigerant circuit through the suction port and sent into the compression chamber 22 through a suction passage 27 arranged in the middle housing member 12. The refrigerant is compressed in the compression chamber 22. The compressed refrigerant in the compression chamber 22 is sent into the discharge passage 28, forced through the discharge valve 29, and discharged into the discharge chamber 15. The discharged refrigerant in the discharge chamber 15 then flows through the discharge port 16 into the external refrigerant circuit and returns to the middle housing member 12.

A wiring connection unit 50 connected to the motor driving circuit 30 will now be described.

The inverter housing member 14, which is cylindrical and has a closed end, includes a lid 14*a* and a circumferential wall 14*c*, which extends from the circumference of the lid 14*a*. The circumferential wall 14*c* (housing H) includes a wiring connection port 14*b* that extends through the circumferential wall 14*c*. The wiring connection unit 50 is partially inserted in the wiring connection port 14*b* and coupled to the inverter housing member 14. A seal 14*d* is arranged between the inner surface of the wiring connection port 14*b* and the wiring connection unit 50.

Figure 2:
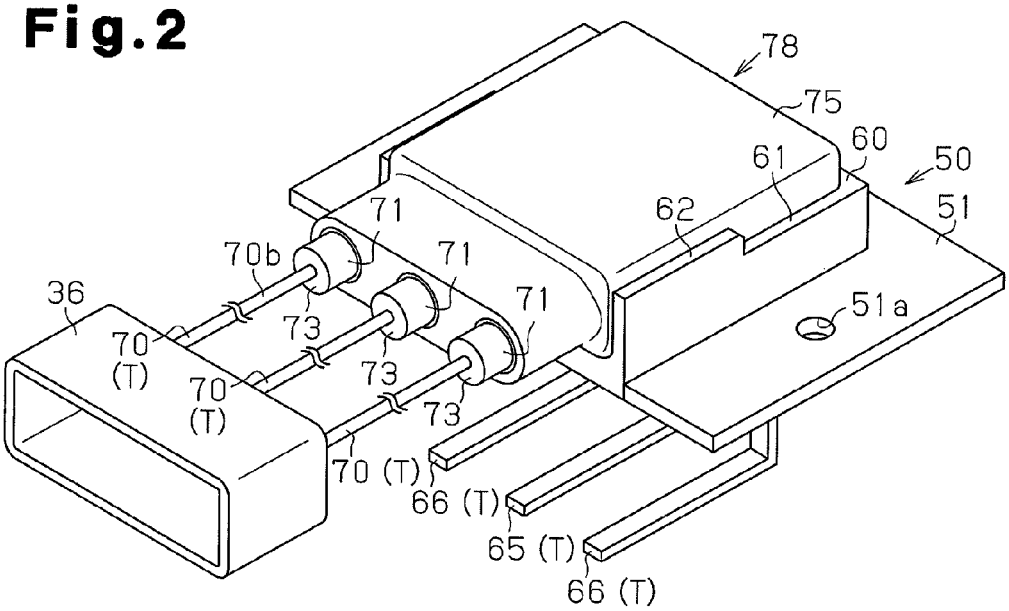
FIG. 2 is a perspective view showing a wiring connection unit of the motor-driven compressor of FIG. 1.

As shown in FIG. 2, the wiring connection unit 50 includes a base 51, which is formed by a metal (iron) plate. The base 51 has a longitudinal end including a coupling bore 51*a*. A coupling member (not shown) is inserted through the coupling bore 51*a* of the base 51 and fastened to the inverter housing member 14 to couple the wiring connection unit 50 to the inverter housing member 14.

Figure 4:
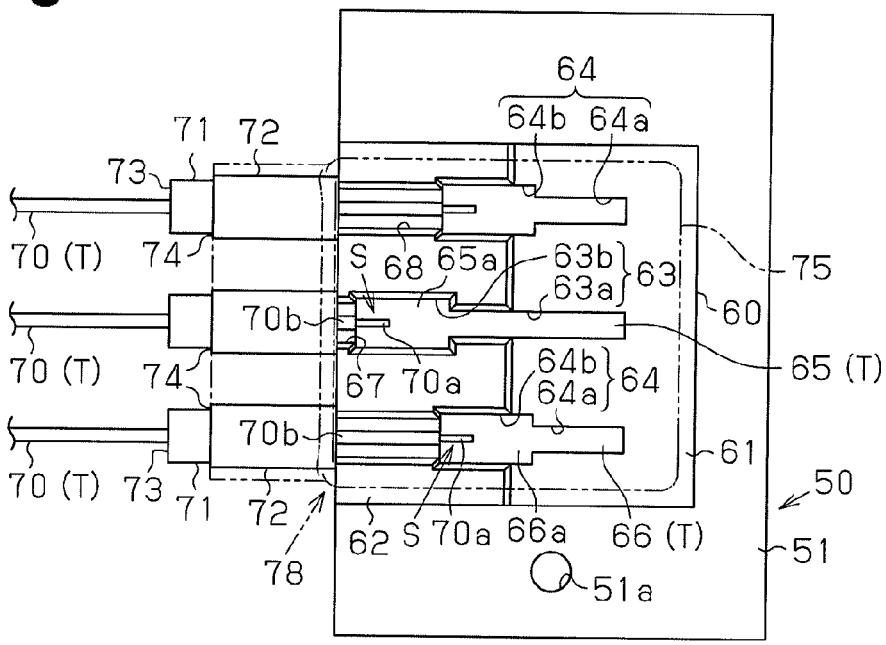
FIG. 4 is a plan view showing the wiring connection unit of FIG. 2.
Figure 5:
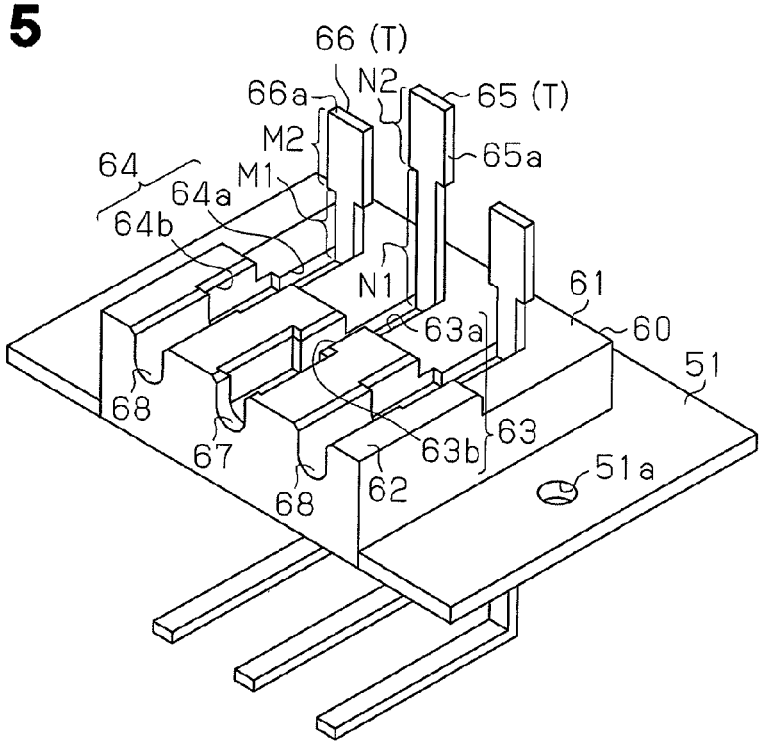
FIG. 5 is a perspective view showing a mount and bus bars of the wiring connection unit of FIG. 4.
Figure 7:
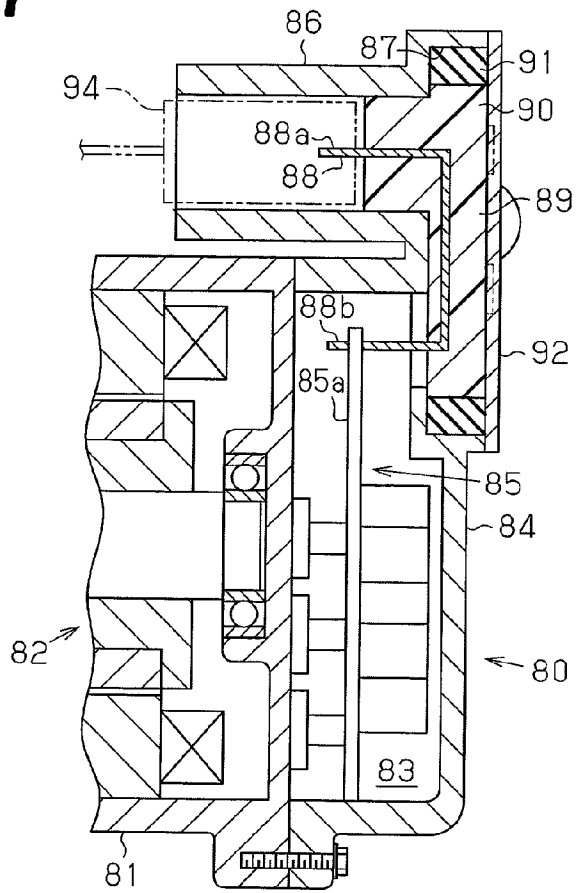
FIG. 7 is a partial cross-sectional view showing the background art.

As shown in FIGS. 4 and 5, the wiring connection unit 50 includes a resin mount 60, which is formed integrally with the base 51. The mount 60 has two steps that are at different distances from the base 51. Namely, the mount 60 includes a first mount portion 61 and a second mount portion 62. The second mount portion 62 is further from the base 51 than the first mount portion 61.

The mount 60 includes a primary bus bar groove 63, which extends from the first mount portion 61 to the second mount portion 62, and two secondary bus bar grooves 64, which are arranged on opposite sides of the primary bus bar groove 63. In the present embodiment, the single primary bus bar groove 63 and the two secondary bus bar grooves 64 function as primary conductor grooves. The primary bus bar groove 63 includes a straight portion 63*a*, which has a uniform width and extends from the first mount portion 61 to the second mount portion 62, and a wide portion 63*b*, which is continuous with the straight portion 63*a*. The wide portion 63*b* is located in the second mount portion 62 and wider than the straight portion 63*a*. Each secondary bus bar groove 64 includes a straight portion 64*a*, which has a uniform width and extends in the first mount portion 61, and a wide portion 64*b*, which is continuous with the straight portion 64*a* and extends from the first mount portion 61 to the second mount portion 62. The wide portion 64*b* has a uniform width and is wider than the straight portion 64*a*.

The straight portion 63*a* of the primary bus bar groove 63 is longer in the axial direction than the straight portion 64*a* of each secondary bus bar groove 64. The wide portions 63*b*, 64*b* have the same axial length. Accordingly, in the mount 60, the wide portion 63*b* of the primary bus bar groove 63 is separated from the wide portion 64*b* of each secondary bus bar groove 64 in the axial direction. The wide portion 63*b* of the primary bus bar groove 63 and the wide portion 64*b* of each secondary bus bar groove 64 have the same width.

The mount 60 holds one primary bus bar 65 and two secondary bus bars 66, which function as primary conductors. The secondary bus bars 66 are arranged on opposite sides of the primary bus bar 65. The plate-like primary and secondary bus bars 65, 66 each have a first axial end (lower end as shown in FIG. 5), which is connected to the substrate 31, and a second axial end (upper end as shown in FIG. 5), which is connected to a wire 70. The wires 70 function as secondary conductors.

Figure 3:
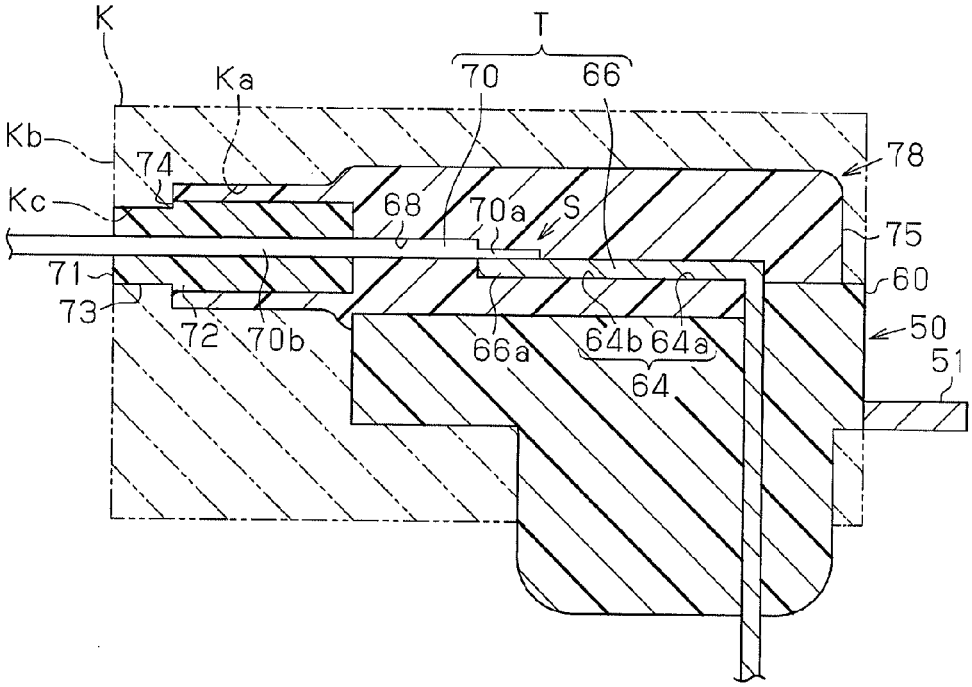
FIG. 3 is a cross-sectional view showing the wiring connection unit of FIG. 2.

As shown in FIGS. 3 and 4, the wires 70 each include a wire portion 70*a*, which is a conductor, and a sheath 70*b*, which is made of an insulating material and covers the wire portion 70*a*. The wire portions 70*a* have ends that are exposed from the sheaths 70*b* and welded to the primary and secondary bus bars 65, 66. In the present embodiment, resistance welding is performed to weld the wire portions 70*a* to the primary and secondary bus bars 65, 66*g*. The wire portions 70*a* are connected to the primary and secondary bus bars 65, 66 at junctions S. As shown in FIG. 2, the other ends of the wire portions 70*a* of the wires 70 are connected to a connector 36.

As shown in FIG. 5, the primary bus bar 65 and the secondary bus bar 66 differ in length in the axial direction from the mount 60 to the second ends, which include the junctions S. The primary bus bar 65 is longer than the secondary bus bars 66. In other words, the second end of the primary bus bar 65 is separated from the second ends of the secondary bus bars 66 in the direction in which the second ends extend. FIG. 5 shows the wiring connection unit 50 before the primary and secondary bus bars 65, 66 are bent. Here, the second end of the primary bus bar 65 projects from the primary bus bar groove 63. The second end of the primary bus bar 65 includes a wire connection portion 65*a* that is connected to the wire 70 and wider than other portions of the primary bus bar 65. In the primary bus bar 65, the length N1 from the bottom of the straight portion 63*a* of the primary bus bar groove 63 to the wire connection portion 65*a* is slightly longer than the axial length of the straight portion 63*a* in the primary bus bar groove 63. Further, the length N2 of the wire connection portion 65*a* is shorter than the axial length of the wide portion 63*b* of the primary bus bar groove 63. In FIG. 4, the primary bus bar 65 is bent toward the primary bus bar groove 63 so that the wire connection portion 65*a* is received in the wide portion 63*b*, and a portion other than the wire connection portion 65*a* is received in the straight portion 63*a*.

In addition, the second ends of the secondary bus bars 66 project from the secondary bus bar grooves 64 as shown in FIG. 5. The second end of each secondary bus bar 66 includes a wire connection portion 66*a* that is connected to the wire 70 and is wider than other portions of the secondary bus bar 66. In the secondary bus bar 66, the length M1 from the bottom of the straight portion 64*a* of the secondary bus bar groove 64 to the wire connection portion 66*a* is slightly longer than the axial length of the straight portion 64*a* in the secondary bus bar groove 64. The length M2 of the wire connection portion 66*a* is the same as the length N2 of the wire connection portion 65*a* in the primary bus bar 65 and shorter than the axial length of the wide portion 64*b* in the secondary bus bar groove 64. As shown in FIG. 4, the secondary bus bars 66 are each bent toward the corresponding secondary bus bar groove 64 so that the wire connection portion 66*a* is received in the wide portion 64*b* and a portion other than the wire connection portion 66*a* is received in the straight portion 64*a*.

As shown in FIG. 5, the second mount portion 62 of the mount 60 includes a primary wire groove 67, which is continuous with the primary bus bar groove 63 and functions as a secondary conductor groove. The primary wire groove 67 is slightly narrower than the wide portion 63*b* of the primary bus bar groove 63. The primary wire groove 67 receives the wire 70 that is connected to the primary bus bar 65. Each second mount portion 62 also includes secondary wire groove 68, which is continuous with the corresponding secondary bus bar groove 64 and functions as a secondary conductor groove. The secondary wire groove 68 is slightly narrower than the wide portion 64*b* of the corresponding secondary bus bar groove 64. The secondary wire groove 68 receives the wire 70 that is connected to the corresponding secondary bus bar 66.

As shown in FIG. 4, in the wiring connection unit 50, the wires 70 are each inserted in a tubular seal 71, which is supported by the mount 60. The tubular seal 71 is made of an elastic resin (polyamide in the present embodiment). The tubular seal 71 is cylindrical and includes a first tubular portion 72 and a second tubular portion 73 that is continuous with the first tubular portion 72 in the axial direction. The second tubular portion 73 has a smaller diameter than the first tubular portion 72. The tubular seal 71 also includes a step 74 at the border between the first and second tubular portions 72, 73. The step 74 is formed by an end surface of the first tubular portion 72. As shown in FIG. 3, when the wire 70 is inserted in the tubular seal 71, the inner surface of the tubular seal 71 is in close contact with the outer surface of the wire 70 (sheath 70*b*) due to the elastic force of the tubular seal 71. Thus, the outer surface of the wire 70 (sheath 70*b*) is sealed by the inner surface of the tubular seal 71.

In the wiring connection unit 50, the surface of the mount 60 is covered by a cover 75, which is made of a resin (polyamide in the present embodiment). Thus, the second ends of the primary and secondary bus bars 65, 66, part of each wire 70 (sheath 70*b*), and the junctions S, which are supported by the mount 60, are covered by the mount 60 and the cover 75. The resin of the cover 75 fills the primary and secondary bus bar grooves 63, 64 and adheres to the second ends of the primary and secondary bus bars 65, 66, part of each wire 70 (sheath 70*b*), and the junctions S. Accordingly, the mount 60 and the cover 75 seal the second ends of the primary and secondary bus bars 65, 66, part of each wire 70 (sheath 70*b*), and the junctions S. The mount 60 and the cover 75 form a sealing member 78. The sealing member 78 insulates the junctions S from the exterior.

As shown in FIGS. 2 to 4, the cover 75 and the mount 60 cooperate to cover the outer surfaces of the first tubular portions 72 of the tubular seals 71. The tubular seals 71 are held by the cover 75 and attached to the mount 60. The tubular seals 71, the cover 75, and the mount 60 are made of the same resin to ensure adhesion between one another. The cover 75 and the mount 60 thus adhere to the outer surfaces of the first tubular portions 72. Accordingly, in the present embodiment, the sealing member 78 includes the tubular seals 71 in addition to the mount 60 and the cover 75.

The wiring connection unit 50 is coupled to the inverter housing member 14 before the inverter housing member 14 is coupled to the middle housing member 12. More specifically, the wiring connection unit 50 is coupled to the inverter housing member 14 by fitting part of the sealing member 78 of the wiring connection unit 50 into the wiring connection port 14*b* and fastening the base 51 to the inverter housing member 14. Here, the sealing member 78 includes the seal 14*d*, which is in close contact with the inner surface of the wiring connection port 14*b*. The seal 14*d* seals the wiring connection port 14*b*.

Then, when the inverter housing member 14 is attached to the middle housing member 12, the first ends of the primary and secondary bus bars 65, 55 are electrically connected to the substrate 31. This electrically connects the wiring connection unit 50 with the motor driving circuit 30.

As shown in FIG. 1, when the wiring connection unit 50 is coupled to the inverter housing member 14, the primary and secondary bus bars 65, 66 and the wires 70 connect the motor driving circuit 30 to the connector 36. The primary and secondary bus bars 65, 66 and the wires 70 form wiring T, which is electrically connected to the motor driving circuit 30 and drawn out of the housing H. The wires 70 extend from the sealing member 78 along the outer surface of the circumferential wall 14*c* of the inverter housing member 14. The distance between the wiring connection unit 50 and the inverter housing member 14 is set in correspondence with the cover 75. In addition, a vehicle connector 77 is connected to the connector 36, which is electrically connected to the motor driving circuit 30 by the wiring T.

The operation of the motor-driven compressor 10 that includes the wiring connection unit 50 will now be described.

The wiring connection unit 50 is coupled to the inverter housing member 14 of the housing H, and the sealing member 78 of the wiring connection unit 50 is fitted to the wiring connection port 14*b*. The sealing member 78 holds the primary and secondary bus bars 65, 66. The first ends of the primary and secondary bus bars 65, 66 are connected to the motor driving circuit 30 in the accommodating chamber 17. The second ends of the primary and secondary bus bars 65, 66 are connected to the wires 70. The primary and secondary bus bars 65, 66, the sheaths 70*b* of the wires 70, and the junctions S are covered and sealed by the sealing member 78 (cover 75 and mount 60). Accordingly, the junctions S, which connect the primary and secondary bus bars 65, 66 with the wires 70, are sealed by the sealing member 78.

Furthermore, the primary and secondary bus bars 65, 66 are connected with the wires 70, and the wires 70 are connected to the connector 36. Thus, the wires 70 increase the freedom of layout for the connector 36. Since the connector 36 is discrete from the inverter housing member 14 and not fixed to the inverter housing member 14, the motor-driven compressor 10 may be reduced in size as compared to when the connector 36 is formed integrally with the inverter housing member 14 and projected from the inverter housing member 14.

A method for manufacturing the wiring connection unit 50 will now be described. In the wiring connection unit 50 described below, the mount 60 is attached to the base 51 in advance, and the primary and secondary bus bars 65, 66 are held by the mount 60.

Figure 6:
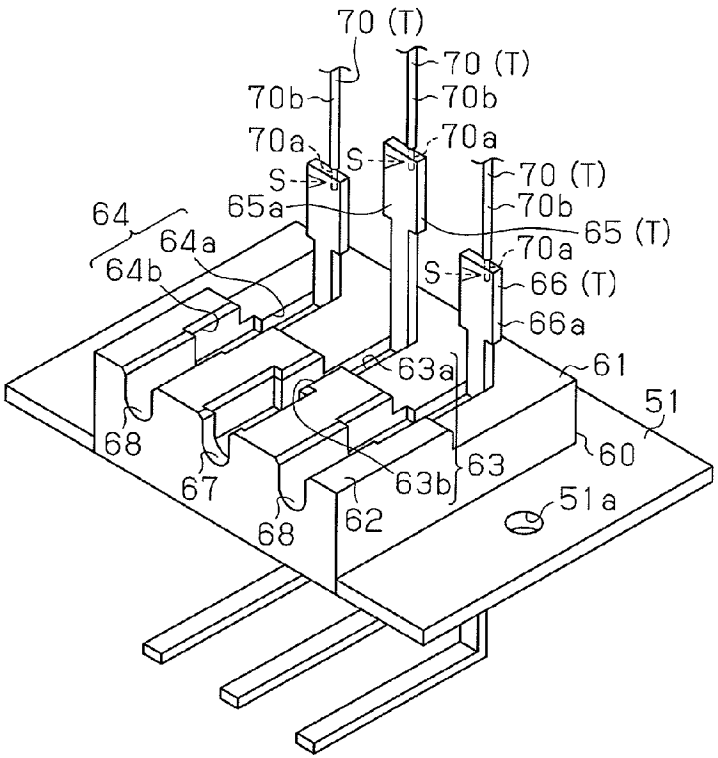
FIG. 6 is a perspective view showing the wiring connection unit of FIG. 4 in which the bus bars are connected with wires.

First, as shown in FIG. 6, the wire portions 70*a* of the wires 70 are welded to the wire connection portions 65*a*, 66*a* of the primary and secondary bus bars 65, 66 to form the junctions S. Then, as shown in FIG. 4, the primary and secondary bus bars 65, 66 are bent toward the primary and secondary bus bar grooves 63, 64 so that the wire connection portions 65*a*, 66*a* are accommodated in the wide portions 63*b*, 64*b* and the other portions of the primary and secondary bus bars 65, 66 are accommodated in the straight portions 63*a*, 64*a*. In addition, the wires 70 are accommodated in and supported by the primary and secondary wire grooves 67, 68.

Then, the wires 70 are inserted into the tubular seals 71 so that the sheaths 70*b* of the wires 70 are in contact with the inner surfaces of the tubular seals 71. The mount 60 and the tubular seals 71 are then arranged in a mold K, which is indicated by the double-dashed lines in FIG. 3. The mold K includes a side wall Kb, which defines a cavity Ka of the mold K. The side wall Kb includes through holes Kc that are in communication with the cavity Ka. Each through hole Kc has a diameter that is about the same as the outer diameter of the second tubular portions 73. The second tubular portions 73 of the tubular seals 71 are arranged in the through holes Kc.

Accordingly, when the tubular seals 71 are accommodated in the cavity Ka, the steps 74 of the tubular seals 71 are in contact with the inner surface of the side wall Kb, and the surfaces defining the through holes Kc are in contact with the outer surfaces of the second tubular portions 73. Then, the cavity Ka is filled with the same resin as the tubular seals 71. The resin is a thermosetting resin. Thus, when the resin is filled into the mold K that is heated to a high temperature, the resin is hardened by the heat of the mold K. This forms the cover 75. After the cover 75 is formed, the mold K is opened to remove the wiring connection unit 50.

The advantages of the present embodiment will now be described.

(1) The wiring connection unit 50 is attached to the inverter housing member 14 by fitting the sealing member 78 to the wiring connection port 14*b* of the inverter housing member 14. The first ends of the primary and secondary bus bars 65, 66, which are held by the sealing member 78 of the wiring connection unit 50, are connected to the substrate 31 of the motor driving circuit 30 in the accommodating chamber 17. In addition, the second ends of the primary and secondary bus bars 65, 66 are connected with the wires 70. Therefore, the wires 70 are arranged outside the housing H. The connector 36, which is connected with the wires 70, is used to electrically connect the substrate 31 with the vehicle connector 77, which is discrete from the motor-driven compressor 10. Accordingly, the motor-driven compressor 10 does not include a connector coupler that is formed integrally with the housing H. Due to the elimination of such a connector coupler, a connector coupler no longer projects from the housing H of the motor-driven compressor 10. This reduces the size of the motor-driven compressor 10. Further, there is no connector coupler that becomes an obstacle when installing the motor-driven compressor 10 to a vehicle. In addition, the wires 70 allow the connector 36 and the vehicle connector 77 to be connected with each other at various locations. This facilitates the connection between the wiring connection unit 50 and the vehicle connector 77.

(2) The sealing member 78 of the motor-driven compressor 10 is fitted to the wiring connection port 14*b* of the inverter housing member 14, and the primary and secondary bus bars 65, 66 electrically connect the substrate 31 to the wires 70. The wires 70, which are held by the sealing member 78, are connected to the connector 36. Thus, the connector 36 and the vehicle connector 77 can be connected with each other at any location by extending the wires 70. As a result, the substrate 31 is connected to the vehicle at a single point where the vehicle connector 77 is connected to the connector 36. If a connector coupler were arranged integrally with the housing H and direct connection between the connector coupler and the vehicle connector 77 were to be difficult, a separate connecting cable would be needed between the connector coupler and the vehicle connector 77. This results in two points where the substrate 31 and the vehicle are connected. Compared to such a structure in which a connector coupler is formed integrally with the housing H, the motor-driven compressor 10 according to the present embodiment allows for reduction in the number of connecting points, improved reliability, and fewer components.

(3) The wires 70 are connected to the second ends of the primary and secondary bus bars 65, 66, and the junctions S are covered and sealed by the sealing member 78 of the wiring connection unit 50. The sealing member 78 is fitted to the wiring connection port 14*b* of the inverter housing member 14, and the first ends of the primary and secondary bus bars 65, 66 are connected to the substrate 31. Thus, the wiring T may be extended from the substrate 31. Accordingly, compared to a structure in which the wires 70 are directly connected to the substrate 31, the present embodiment facilitates electrical connection tasks.

(4) In the wiring connection unit 50, the sealing member 78 covers and seals part of the primary and secondary bus bars 65, 66, part of the wires 70 (sheaths 70*b*), and the junctions S. Thus, the sealing member 78 makes the sheaths 70*b* and the junctions S insulative and impervious to water. In addition, the seal 14*d* seals the wiring connection port 14*b*.

(5) The sealing member 78 includes the mount 60, which supports the primary and secondary bus bars 65, 66 and the wires 70, and the cover 75, which cooperates with the mount 60 to cover the junctions S. Since the primary and secondary bus bars 65, 66 and the wires 70 are supported by the mount 60, the primary and secondary bus bars 65, 66 and the wires 70 are not displaced when covering and sealing the primary and secondary bus bars 65, 66 and the wires 70 with the mount 60 and the cover 75. This facilitates the sealing of the primary and secondary bus bars 65, 66 and the wires 70 with the cover 75.

(6) In particular, the mount 60 supports the wires 70 and eliminates the need for positioning and supporting of the wires 70 in the mold K. Further, damages to the wires 70 may be avoided when closing the mold K.

(7) The wire 70 is inserted in the tubular seal 71. The tubular seal 71 produces an elastic force that holds the inner surface of the tubular seal 71 in contact with the surface of the wire 70 (sheath 70*b*). This ensures sealing that is impervious to water between the surface of the wire 70 and the inner surface of the tubular seals 71. In addition, the outer surface of the tubular seals 71 is sealed by the cover 75 and the mount 60. This ensures sealing of the wires 70 and the junctions S.

(8) The portion of each wire 70 located in the sealing member 78 is covered by the tubular seal 71. Accordingly, when molding the cover 75 from resin, the tubular seal 71 prevents the mold K and the resin, which are heated to high temperatures, from directly contacting the wire 70 and thus protects the wire 70 (sheath 70*b*) from the heat.

(9) The cover 75 and the mount 60 of the sealing member 78 are molded from a thermosetting resin. Each tubular seal 71 includes the first tubular portion 72 and the second tubular portion 73. During molding, the first tubular portion 72 is accommodated in the cavity Ka, and the second tubular portion 73 is arranged in the through hole Kc, which is in communication with the cavity Ka. Thus, when closing the mold K, the mold K, which is heated to a high temperature, contacts the second tubular portion 73. In other words, the second tubular portion 73 prevents the heated mold Ka from contacting the wire 70 and thus protects the wire 70 during the molding. This eliminates the need for a wire that withstands high temperatures when manufacturing the wiring connection unit 50 (sealing member 78), and allows for the use of inexpensive wires as the wires 70.

(10) Each tubular seal 71 includes the first tubular portion 72 and the second tubular portion 73, which is continuous with the first tubular portion 72 and has a smaller diameter than the first tubular portion 72. The tubular seal 71 also includes the step 74 located at the border between the first tubular portion 72 and the second tubular portion 73. When molding the cover 75, the second tubular portion 73 is arranged in the through hole Kc of the mold K, and the step 74 of the tubular seals 71 contacts the side wall Kb of the mold K around the through hole Kc. This keeps the tubular seal 71 in the cavity Ka when molding the cover 75, and ensures that the tubular seals 71 are formed integrally with the cover 75.

(11) The sealing member 78 of the wiring connection unit 50 holds one primary bus bar 65 and two secondary bus bars 66. The second ends of the primary and secondary bus bars 65, 66 extend in the same direction next to each other on the mount 60. In addition, the second end of the primary bus bar 65 is separated from the second ends of the secondary bus bars 66 in the direction in which the second ends extend. Accordingly, when the primary and secondary bus bars 65, 66 extend upright from the mount 60, adjacent ones of the primary and secondary bus bars 65, 66 differ in height so that the adjacent second ends are staggered. This facilitates the task of connecting the wires 70 and the primary and secondary bus bars 65, 66 since an adjacent bus bar will not be an obstacle when connecting the wires 70 to the second ends of the primary and secondary bus bars 65, 66.

(12) The second ends of the primary and secondary bus bars 65, 66 include the wire connection portions 65*a*, 66*a*. The wire connection portions 65*a*, 66*a* are wider than the other portions of the primary and secondary bus bars 65, 66. This facilitates the connection with the wires 70 compared to when the wire connection portions 65*a*, 66*a* are not as wide and the primary and secondary bus bars 65, 66 have uniform widths in the axial direction.

(13) The primary and secondary bus bars 65, 66 have different axial lengths, and the wire connection portions 65*a*, 66*a* in adjacent ones of the second ends of the primary and secondary bus bars 65, 66 are staggered. That is, in adjacent ones of the primary and secondary bus bars 65, 66, the wire connection portion 65*a* of the primary bus bar 65 is not at the same position as the wire connection portions 66*a* of the secondary bus bars 66. This allows the mount 60 and the cover 75 to be narrower in the direction the primary and secondary bus bars 65, 66 are laid out compared to when the wire connection portions 65*a*, 66*a* are aligned. This reduces the size of the sealing member 78. In addition, when connecting a wire 70 to one of the wire connection portions 65*a*, 66*a*, there is no interference with other wire connection portions 65*a*, 66*a* since the positions of the wire connection portions 65*a*, 66*a* are staggered.

(14) The wire portions 70*a* of the wires 70 are connected to the wire connection portions 65*a*, 66*a* by resistance welding. This facilitates the connection compared to when the wire portions 70*a* were connected to the wire connection portions 65*a*, 66*a* by crimping for example. In addition, the connecting work can be conducted in small space on the mount 60 since a crimping jig is not required.

(15) The wire portions 70*a* of the wires 70 are connected to the wire connection portions 65*a*, 66*a* by resistance welding. This avoids the scattering of soldering flux, which may occur when soldering the wire portions 70*a* and the wire connection portions 65*a*, 66*a*. Soldering flux decreases the adhesiveness between the cover 75 and the mount 60 and is not desirable. The resistance welding allows easy connection between the wires 70 and the primary and secondary bus bars 65, 66 and does not reduce the adhesiveness between the cover 75 and the mount 60.

(16) The mount 60 includes the primary and secondary bus bar grooves 63, 64 that accommodate the primary and secondary bus bars 65, 66. Thus, the mount 60 includes resin partitions between adjacent ones of the primary bus bar groove 63 and the secondary bus bar grooves 64. Accordingly, when the primary and secondary bus bars 65, 66 are accommodated in the primary and secondary bus bar grooves 63, 64, the primary bus bar 65 is insulated from the adjacent secondary bus bars 66.

(17) The mount 60 includes the primary and secondary bus bar grooves 63, 64, which accommodate the primary and secondary bus bars 65, 66. The primary and secondary bus bar grooves 63, 64 include the wide portions 63*b*, 64*b*. Thus, resin easily enters the wide portions 63*b*, 64*b* when molding the cover 75. This ensures sealing of the primary and secondary bus bars 65, 66 and the junctions S with the resin.

(18) The mount 60 includes the primary and secondary wire grooves 67, 68, which accommodate the wires 70. The primary and secondary wire grooves 67, 68 stably support the wires 70, which extend through the sealing member 78.

(19) The tubular seal 71 is made of the same resin as the cover 75 and the mount 60 of the sealing member 78. This increases adhesiveness of the tubular seal 71 to the cover 75 and the mount 60 and ensures sealing of a gap around the outer surface of the tubular seal 71 between the cover 75 and the mount 60.

(20) The wires 70 extend from the sealing member 78 of the wiring connection unit 50 along the outer surface of the housing H. Thus, the motor-driven compressor 10 occupies less space compared to when the wires 70 extend perpendicular to the outer surface of the housing H, for example.

It should be apparent to those skilled in the art that the present invention may be embodied in many other specific forms without departing from the spirit or scope of the invention. Particularly, it should be understood that the present invention may be embodied in the following forms.

The tubular seal 71 may be made of a resin that differs from the resin of the cover 75 and the mount 60.

The mount 60 does not have to include the primary and secondary wire grooves 67, 68.

The mount 60 does not have to include the primary and secondary bus bar grooves 63, 64.

The primary and secondary bus bars 65, 66 may be connected to the wire portions 70*a* of the wires 70 through soldering or direct welding.

The primary and secondary bus bars 65, 66 may have uniform widths in the axial direction, and the wire connection portions 65*a*, 66*a* may be omitted.

The primary and secondary bus bars 65, 66 may have the same axial length.

The number of the primary and secondary conductors may be varied.

The tubular seal 71 may be a cylinder that has a uniform outer diameter and does not include the step 74.

In the above embodiment, the sealing member 78 includes the mount 60 and the cover 75, which is formed on the mount 60. However, the sealing member 78 may be formed from resin by sealing part of the primary and secondary bus bars 65, 66, part of the wires 70 (sheaths 70*b*), and the junctions S. The sealing member 78 may then be attached to the base 51 to form the wiring connection unit 50, which is coupled to the inverter housing member 14.

In the above embodiment, the sealing member 78 is formed as part of the wiring connection unit 50, which is attached to the inverter housing member 14 using the base 51. However, the sealing member 78 may be directly coupled to the inverter housing member 14 without using the base 51. For example, a sealing member that holds and seals part of the primary and secondary bus bars 65, 66, part of the wires 70 (sheaths 70*b*), and the junctions S may be fitted to the wiring connection port 14*b* of the inverter housing member 14. The tubular seals 71 may be formed integrally with the sealing member or be omitted.

In the above embodiment, the compression unit is of a scroll type. However, the compression unit may be of other types such as a vane type.

The present invention is not limited to vehicle air-conditioning devices and is applicable to other air-conditioning devices.

Therefore, the present examples and embodiments are to be considered as illustrative and not restrictive and the invention is not to be limited to the details given herein, but may be modified within the scope and equivalence of the appended claims.

The invention claimed is:

1. A motor-driven compressor comprising:

a compression unit that performs a compression operation;

an electric motor that drives the compression unit;

a housing that accommodates the compression unit and the electric motor and includes an accommodating chamber and a wiring connection port, which communicates the accommodating chamber and the exterior of the housing;

a motor driving circuit that controls driving of the electric motor and includes a substrate, which is arranged in the accommodating chamber;

wiring electrically connected to the substrate and extending out of the housing through the wiring connection port; and a resin sealing member fitted to the wiring connection port, wherein the wiring includes a primary conductor, which has a first end connected to the substrate and a second end, and a secondary conductor, which is connected to the second end of the primary conductor and arranged outside the housing, the secondary conductor includes a wire portion and a sheath that is made of an insulating material and covers the wire portion, and the sealing member covers the sheath and a junction between the primary conductor and the secondary conductor, wherein the sealing member includes a mount, which supports the primary and secondary conductors, and a cover, which cooperates with the mount to cover the junction and the sheath, wherein the sealing member includes a tubular seal into which the sheath is inserted, the tubular seal produces elastic force that keeps the tubular seal in contact with the sheath, and the tubular seal is covered by the cover and the mount, wherein the cover and the mount are molded from a thermosetting resin, the tubular seal includes a first tubular portion, a second tubular portion, and a step, the first tubular portion is covered by the cover and the mount, the second tubular portion is continuous in an axial direction, with the first tubular portion, has a smaller diameter than the first tubular portion, and projects from the mount, and the step is located at a border between the first and second tubular portions.

2. The motor-driven compressor according to claim 1, wherein the sealing member includes a seal that seals the wiring connection port.

3. The motor-driven compressor according to claim 1, wherein the primary conductor is one of a plurality of primary conductors, the secondary conductor is one of a plurality of secondary conductors, the second ends of the primary conductors extend in the same direction, the primary conductors are arranged adjacent to each other, and the second ends of adjacent ones of the primary conductors are separated from each other in the direction in which the second ends extend.

4. The motor-driven compressor according to claim 1, wherein the primary conductor is a planar bus bar, the second end of the primary conductor includes a wire connection portion connected to the secondary conductor, and the wire connection portion is wider than a portion other than the wire connection portion of the primary conductor.

5. The motor-driven compressor according to claim 1, wherein the primary conductor and the secondary conductor are connected to each other through welding or soldering.

6. The motor-driven compressor according to claim 1, wherein the mount includes a primary conductor groove that accommodates the primary conductor.

7. The motor-driven compressor according to claim 1, wherein the mount includes a secondary conductor groove that accommodates the secondary conductor.

8. The motor-driven compressor according to claim 1, wherein the tubular seal, the cover, and the mount are made of the same material.

9. The motor-driven compressor according to claim 1, wherein the secondary conductor extends from the sealing member along an outer surface of the housing.

* * * * *